United States Patent [19]

Ishimoto

[11] Patent Number: 4,713,499

[45] Date of Patent: Dec. 15, 1987

[54] OPERATION CONTACT SYSTEM OF TRANSMITTER FOR THE RADIO-CONTROLLING TOY

[75] Inventor: Zenichi Ishimoto, Tokyo, Japan

[73] Assignee: Nikko Co., Ltd., Tokyo, Japan

[21] Appl. No.: 892,945

[22] Filed: Aug. 4, 1986

[51] Int. Cl.[4] ..... H01H 15/00

[52] U.S. Cl. ..... 200/16 D

[58] Field of Search ..... 200/16 R, 16 C, 16 D, 200/16 F, 276, 292

[56] References Cited

U.S. PATENT DOCUMENTS

| | | | |
|---|---|---|---|
| 3,592,983 | 7/1971 | Kroll et al. | 200/16 D |
| 3,858,012 | 12/1974 | Lockard | 200/16 R X |
| 4,057,520 | 11/1977 | Schwartz | 200/16 D |
| 4,072,833 | 2/1978 | Carena | 200/16 D X |

*Primary Examiner*—J. R. Scott

[57] ABSTRACT

An operation contact system of transmitter for the radio-controlling toy is disclosed which is externally controllable by means of an externally operable contact unit movable associated with the fixed contact unit mounted on the printed circuit board.

1 Claim, 11 Drawing Figures

OPERATION CONTACT SYSTEM OF TRANSMITTER FOR THE RADIO-CONTROLLING TOY

FIELD OF THE INVENTION

This invention relates to a contact system for a transmitter for use with a radio-controlled toy, and more particularly to a contact system for the transmitter for advancing, reversing as well as directional control; e.g. turning to the left or to the right.

BACKGROUND OF THE INVENTION

The conventional radio-controlled toy is generally operative to advance, reverse or turn the toy to the left or to the right, as desired, and for that purpose, the transmitter incorporates a contact system having an externally controllable operation lever as shown in FIG. 1. FIG. 1A is a vertical section through the line 1A—1A, in FIG. 1, for a better appreciation of the construction of the conventional contact system.

As shown in FIGS. 1 and 1A the conventional contact system is comprised of a movable contact member 12 and a fixed contact member 16 (see FIG. 2), the latter being formed in a part of the printed circuit board 14 which includes the control circuit for controlled movement of the toy, the movable contact member 12 and the printed circuit board (and the fixed contacts 16 thereof) being mounted on a casing 10 of the transmitter as shown in FIG. 1A. The movable contact member 12 comprises a slider 20 for shifting to the left and the right, along a pair of guide members 18, 18, a pair of contacts *22a, 22b* forming part of the slider 20. The slider 20 is associated with an oscillator 26 having a working lever 24, the slider being movable leftward and rightward from a neutral position by the working lever, whose rotational movement is translated into linear motion by the rod 28 which in a conventional way fits in a recess provided by the slider 20 for imparting leftward and rightward linear motion to the slider on rotative movement of lever 24 in much the same manner as the movable contact member 42 is moved by engaging projection 52, as hereinafter more fully described with respect to the application embodiment shown in FIGS. 3 and 4.

As previously noted, the fixed contact member 16 is printed in the printed circuit board 14 so as to control printed circuits in the board in accordance with movements of the movable contacts *22a, 22b* relative to the fixed contact members 16.

FIG. 2 shows an operational relationship between the movable contacts (*22a, 22b*) and each pair of fixed contacts ($C_{10}$ with $C_{11}$, $C_{20}$ with $C_{21}$ and $C_{30}$ with $C_{31}$) of the fixed contact unit 16 shown in FIG. 2. Namely contact *22a* may selectively be engaged with contact(s) $C_{10}$ and $C_{20}$, with $C_{20}$ alone (neutral position) or with $C_{20}$ and $C_{30}$, while the movable contact *22b* may selectively be engaged with contact(s) $C_{11}$ and $C_{21}$, with $C_{21}$ alone (neutral position) or with $C_{21}$ and $C_{31}$.

In the contact system of the type described, the printed circuit board 14 is arranged above the slider 20 as shown in FIG. 1A so that the movable contact member 12 comes into contact with the fixed contact member 16 formed in the circuit board. According to such a conventional contact system, however, an insulation masking is partially removed from the printed circuitry so that contamination of and damage is likely to result to the fixed contacts in the printed circuit board. To prevent such possible contamination and damage especially when soldering circuit components on the printed circuit board, the fixed contact member 16 requires special protective and finishing treatment, entailing considerable labor and manufacturing operations.

There is no contact system for a transmitter for radio-controlled toys of which the inventor is aware, which provides a compact contact arrangement having an advantageous association of a fixed contact unit with a movable contact unit and a printed circuit board provided with a fixed contact plate operatively associated with the movable contact in such manner as to protect the contact system of the invention from the kind of contamination and damage referred to.

SUMMARY OF THE INVENTION

A contact system for a transmitter for the use with a radio-controlled toy according to the invention is characterized by comprising a fixed contact unit mounted in a printed circuit board and an externally operable contact unit which is movably associated with the fixed contact unit, said fixed contact unit providing a contact plate which is vertically mounted on the printed circuit board for contact with printed circuits of the printed circuit board at a plurality of points and said externally operable contact unit providing a movable contact piece for embracing the contact plate.

The contact plate is provided at its one side with a plurality of contacts arranged with spaces therebetween and at its opposite side with a single contact; see FIG. 9.

The vertically mounted contact plate is electrically insulatingly carried by a horizontal plate mounted on the printed circuit board, which plate serves as a guide for the externally operable movable contact unit; (see FIGS. 7, 8 and 9).

Further, the externally operable movable contact unit comprises a sliding member having a guide member encompassing the contact plate (see FIGS. 3, 9 and 10), a guide channel and a contact member of conductive metal wire bent symmetrically and an operation member which is arranged in association with the sliding member for imparting linear motion to the sliding member when an oscillator is caused to rotationally move, on operation of a lever, as more specifically hereinafter described.

PREFERRED EMBODIMENTS OF THE INVENTION

A preferred embodiment of the operation contact system of transmitter for the radio-controlling system shall be hereinafter fully described with reference to the accompanying drawings of FIGS. 3 to 10.

Figure 7:
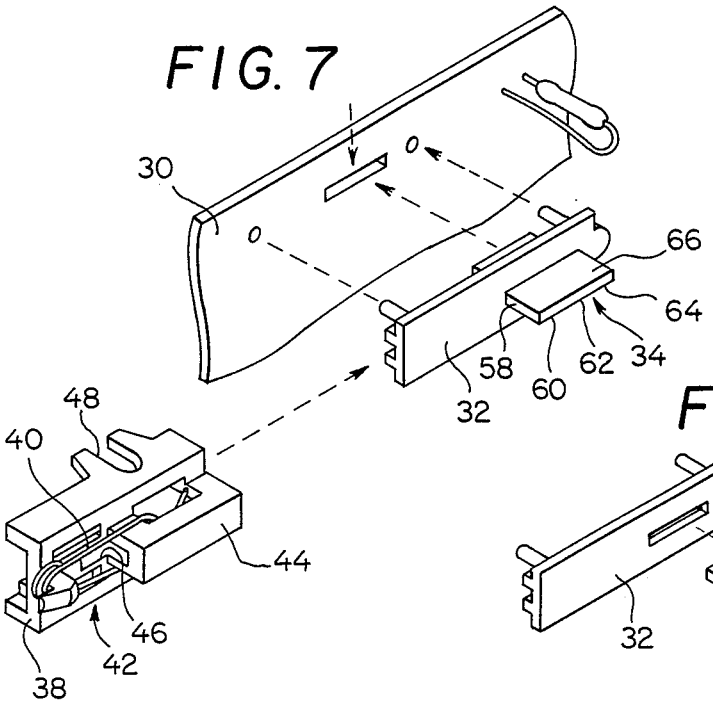
FIG. 7 shows parts of the fixed contact unit and their manner of assembly in relation to a printed circuit board.
Figure 8:
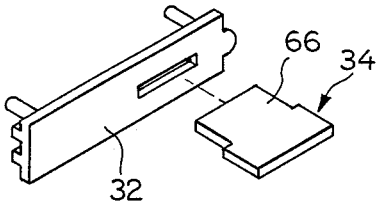
FIG. 8 shows the manner of mounting the contact plate in a fixed mounting.
Figure 10:
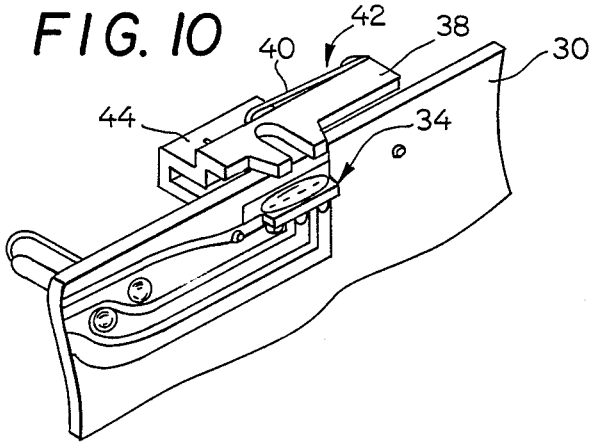
FIG. 10 is a perspective view of the printed circuit board in association with the fixed contact member and the movable contact unit.

In FIGS. 3, 5, 7 and 10, the reference numeral 30 represents a printed circuit board through which partially protrudes a contact plate 34 carried by plate 32 fixed to the printed circuit board in the manner shown in FIG. 7 and as may be gathered from FIG. 10. Fixed plate 32 and contact plate 34 constitute the fixed contact member 36.

On the fixed plate 32 is slidably mounted a sliding member 38 which carries a contact piece 40 of conductive metal wire and which contact piece 40 from one of its ends, secured to one end of the sliding member 38, is divided into two branches which initially diverge from said securement to the sliding member 38 and then converge so as to embrace opposite sides of the contact plate 34. The movable contact unit 42 is thus comprised of sliding member 38 and contact piece 40 and additionally includes a guide member 44 which encompasses the contact plate 34, a guide channel 46 and a recess 48 for engagement with an external oscillation means for shifting the movable contact unit 42.

Figure 1:
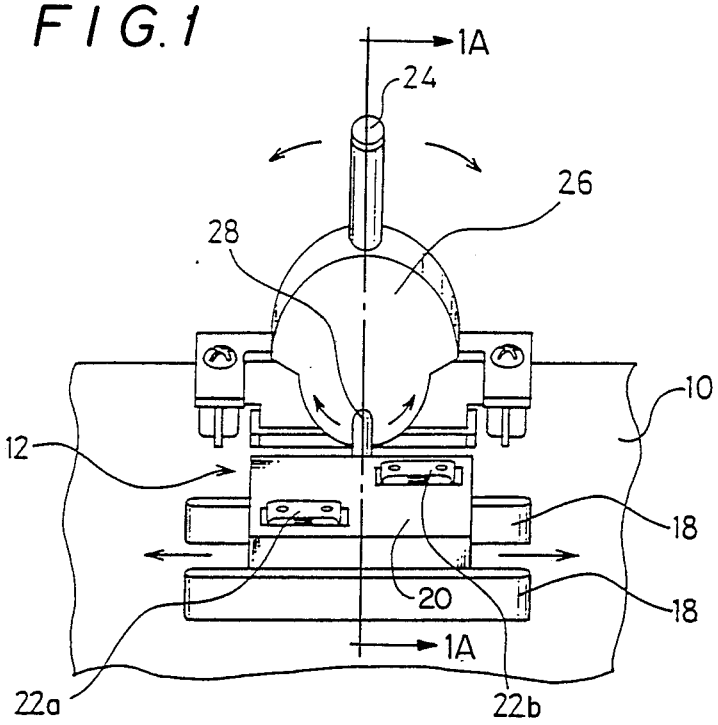
PRIOR ART FIG. 1
FIG. 1 is a pictorial perspective view of the conventional operation contact system, the printed circuit board having been omitted from FIG. 1 for purpose of clarity.
Figure 2:
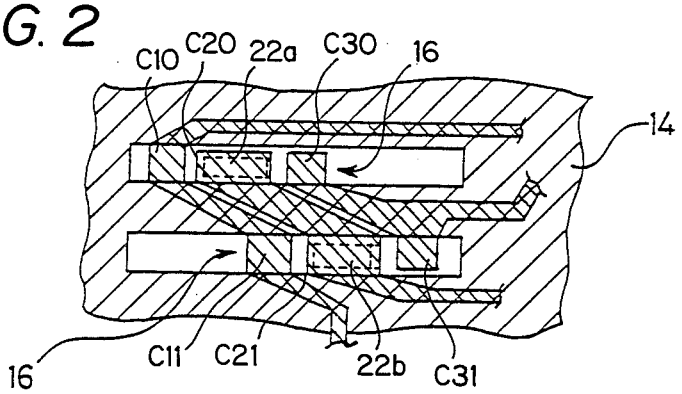
PRIOR ART FIG. 2
FIG. 2 is a pictorial perspective view of the underside of the printed circuitry board showing the fixed contacts therein and in phantom the moveable contacts operatively associated with the fixed contacts in the printed circuit board.
Figure 3:
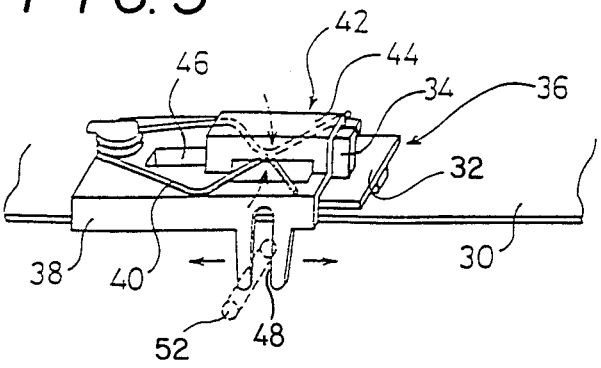
FIG. 3 is a fragmentarily enlarged perspective view of an operation contact system of transmitter for the radio-controlling toy according to the invention.
Figure 4:
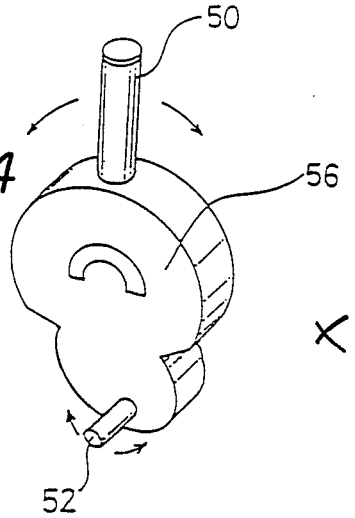
FIG. 4 is a perspective view of an oscillator with an operation lever for use in the operation contact system according to the invention.

In FIG. 4, the oscillation means is seen to comprise an oscillator body 56 which is operatively associated with the movable contact member 42 and so related thereto that engaging projection 52 on the oscillator body fits within recess 48 as shown in FIG. 3, which engaging projection 52 in cooperation with the recess translates rotary movement of the lever 50 into linear movement of the movable contact unit 42.

Figure 5:
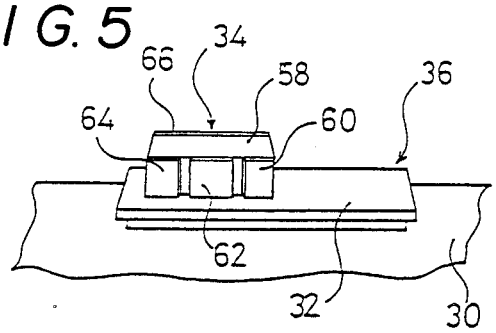
FIG. 5 is a fragmentarily enlarged perspective view of the fixed contact member of the operation contact member shown in FIG. 3.
Figure 6:
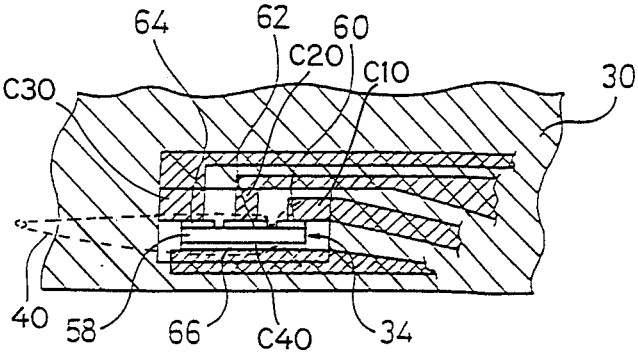
FIG. 6 is a fragmentarily enlarged bottom plan view of the printed circuit board showing the fixed contacts of the fixed contact unit and their engagement with contacts in the circuit board for controlling movement of the toy.
Figure 1A:
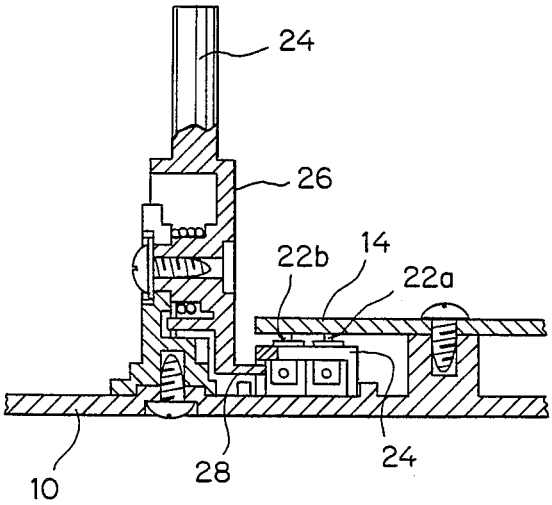
PRIOR ART FIG 1A
FIG. 1A is a vertical section through the line 1A—1A in FIG. 1.
Figure 9:
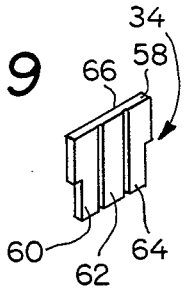
FIG. 9 is a perspective view of the contact plate in accordance with the invention.

In FIGS. 5, 6 and 9, the contact plate 34 will be seen to comprise an insulating plate 58 carried by fixed plate 32 so as to extend through the printed circuit board 30 as shown in FIG. 10 for engagement with contact of the circuit board. Thus contact 60, 62, 64, provided on one side of the insulation plate 58 and contact 66 provided on the opposite side of the insulating plate 58 respectively engage contacts $C_{10}$, $C_{20}$, $C_{30}$ and $C_{40}$ on the printed circuit board.

In operation, the lever 50 is operated to impart linear movement to the sliding member 38, as previously described so that the contact piece 40 selectively engages one of contacts 60, contact 62 or contact 64 with contact 66. The contact piece 40 in its neutral mid-position normally interconnects contact 62 with contact 66. When the sliding member 38 is shifted to the left or the right contact 60 or contact 64 will be interconnected with contact 66 for a predetermined appropriate circuit connection.

As illustrated herein, in the contact system of the invention, the contact plate 34 by means of fixed plate 32 is effectively connected to the contacts of the printed circuit board and providing thereby a fixed contact unit which is related to the movable contact unit to not only simplify the electrical circuitry but also to ensure uncomplicated assembly of parts resulting from the simplified switching arrangement used; e.g. the embrace by the movable conductive metal wire of one of the contacts 60, 62 or 64 with contact 66 of the contact plate 34.

Moreover, the operation contact system according to the present invention requires no special protection, no intermediate processing nor finishing as required in the case of the conventional contact system described, with consequent minimal manufacturing costs.

While the principles of the invention have been made clear in illustrative embodiments, it will be immediately obvious to those skilled in the art that many modifications of structure, arrangement, proportions, elements, materials and components used in the practice of the invention, and otherwise, which are particularly adapted for specific environments and operative requirements may be made without departing from those principles. The appended claims are intended to cover and embrace any and all such modifications, within the limits only of the true spirit and scope of the invention.

What is claimed is:

1. A contact system for a transmitter for use with a radio-controlled toy, comprising a printed circuit board having electrical contacts, a fixed contact assembly provided thereon and an externally operable movable contact assembly mounted in sliding relation to the fixed contact assembly; said fixed contact assembly comprising a contact plate electrically insulatingly carried by a horizontal plate for projection of a part of the contact plate therethrough, said horizontal plate being attached to said printed circuit board with said contact plate extending through said printed circuit board, said contact plate being provided at one side with a plurality of mutually electrically insulated contacts and at its opposite side with a single contact electrically insulated from said mutually insulated contacts, said horizontal plate being adapted to guide said externally operable contact assembly for movement relative to said plurality of contacts and said single contact, said plurality of contacts of the contact plate being connected to said contacts provided in said printed circuit board, said externally operable contact assembly comprising a movable sliding member slidably embracing said fixed contact assembly and a guide channel for ensuring said sliding embracing movement of said fixed contact assembly, said sliding member having a contact piece of conductive metal wire shaped to engage selected ones of said plurality of contacts during movement of said sliding member and simultaneously engage said single contact, said sliding member having means cooperating with an operational means of an operational lever for thus moving said sliding member.

* * * * *